US007379699B2

(12) United States Patent
Nanjo

(10) Patent No.: US 7,379,699 B2
(45) Date of Patent: May 27, 2008

(54) FIXING DEVICE AND IMAGE FORMING APPARATUS

(75) Inventor: Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 250 days.

(21) Appl. No.: 11/384,959

(22) Filed: Mar. 20, 2006

(65) Prior Publication Data

US 2006/0216079 A1 Sep. 28, 2006

(30) Foreign Application Priority Data

Mar. 25, 2005 (JP) ..... 2005-089997

(51) Int. Cl.
*G03G 15/20* (2006.01)

(52) U.S. Cl. ..... 399/333; 219/619

(58) Field of Classification Search ..... 399/333; 219/619, 636, 216

See application file for complete search history.

(56) References Cited

U.S. PATENT DOCUMENTS 6,643,491 B2 * 11/2003 Kinouchi et al. ..... 399/333

7,045,749 B2 * 5/2006 Kinouchi et al. ..... 219/619

FOREIGN PATENT DOCUMENTS

| | | | |
|---|---|---|---|
| JP | 9-127810 | | 5/1997 |
| JP | 2000030850 A | * | 1/2000 |
| JP | 2004-151470 | | 5/2004 |

* cited by examiner

*Primary Examiner*—Susan Lee
(74) *Attorney, Agent, or Firm*—Gerald E. Hespos; Anthony J. Casella

(57) ABSTRACT

A fixing device is provided with a fixing member for thermally fixing a transferred toner image to a transfer material, and a pressing member held in contact with the fixing member to form a nip portion where the transfer material is caused to pass through, wherein the fixing member includes a nonmagnetic metal layer made of nonmagnetic metal, a temperature-sensitive metal layer made of temperature-sensitive metal, and an induction coil for induction heating by supplying magnetism toward the nonmagnetic metal layer and the temperature-sensitive metal layer. The thickness of the nonmagnetic metal layer is set such that an amount of heat produced by the fixing member is larger than an amount of heat evolved singly by the temperature-sensitive metal layer.

16 Claims, 11 Drawing Sheets

VARIATIONS IN PRODUCED HEAT AMOUNT CAUSED BY THE THICKNESS OF NONMAGNETIC METAL LAYER IN THE CASE WHERE NONMAGNETIC METAL AND TEMPERATURE-SENSITIVE METAL WERE COMBINED (AT A TEMPERATURE EQUAL TO OR BELOW CURIE TEMPERATURE)

VARIATIONS IN PRODUCED HEAT AMOUNT CAUSED BY THE THICKNESS OF NONMAGNETIC METAL LAYER IN THE CASE WHERE NONMAGNETIC METAL AND TEMPERATURE-SENSITIVE METAL WERE COMBINED (AT A TEMPERATURE EQUAL TO OR BELOW CURIE TEMPERATURE)

FIXING DEVICE AND IMAGE FORMING APPARATUS

BACKGROUND OF THE INVENTION

1. Field of the Invention

The present invention relates to a fixing device applied to an image forming apparatus such as a copier, a facsimile apparatus or a printer and an image forming apparatus provided with such a fixing device and, particularly to a fixing device for fixing a toner image to a transfer material by induction heating and an image forming apparatus provided with such a fixing device.

2. Description of the Related Art

An image forming apparatus is constructed such that a beam based on image information is emitted to the outer circumferential surface of a rotating photosensitive drum and toner as developer is supplied to an electrostatic latent image thus formed on the outer circumferential surface to form a toner image. The toner image formed on the outer circumferential surface of the photosensitive drum is transferred to a conveyed sheet as a transfer material and fixed to the sheet by heating in a fixing device. The sheet having the toner image fixed thereto is discharged to the outside from an apparatus main body.

The fixing device normally includes a fixing roller heated at a high temperature and a pressure roller opposed to the fixing roller such that the outer circumferential surface thereof is in contact with that of the fixing roller, and a fixing operation is performed by feeding the sheet to a nip portion between these two rollers. A halogen lamp built in the fixing roller has been conventionally used as a heating source for the fixing roller, but it has problems of poor heat efficiency and lacking swiftness due to a long time required to warm up (time required to be sufficiently heated). It has been attempted to reduce the heat capacity of the fixing roller or to thin the fixing roller in order to solve such problems, but there is a limit to it.

Accordingly, in recent years, attention has been paid to a fixing device of the induction heating type for heating a fixing roller by induction heating as disclosed in Japanese Unexamined Patent Publication No. H09-127810. This fixing device of the induction heating type has a fixing roller comprised of a hollow metal roller having good heat conductivity and being nonmagnetic and a magnetic metal thin layer formed on the outer circumferential surface of this hollow metal roller and made of magnetic metal. An induction coil is provided inside such a fixing roller, and the fixing roller is heated by Joule heat produced by exciting the induction coil to produce an eddy current in the magnetic metal thin layer.

By adopting such a fixing device of the induction heating type, the temperature rising rate of the fixing roller is remarkably speeded up as compared to fixing devices of the conventional halogen lamp type, wherefore the warm-up period of the fixing device can be speeded up. However, this has raised a new problem of overheating the fixing roller because the temperature rises too quickly. In order to solve such a problem, a feedback control is executed to detect the temperature of the fixing roller by means of a temperature sensor such as a thermistor or a thermostat and to shut off the supply of power to the induction coil if the detected temperature becomes equal to or higher than a preset temperature, but there still exists an inconvenience that the output of a detection signal from such a temperature sensor may not be able to follow the temperature rise by induction heating due to a time lag, resulting in the overheating of the fixing roller.

Further, as the fixing roller is thinned, there is a tendency to make it more difficult to smoothly transfer heat along longitudinal direction. Thus, if sheets smaller than a heated range are successively fed, heat tends to be trapped at the opposite ends of the heated range where sheets pass at a low frequency. If a fixing operation is applied to a wide sheet in this state, there is an inconvenience of causing an image error such as a so-called offset phenomenon in which a toner image on this sheet is fused and adhered to the fixing roller to be transferred to a next sheet.

In order to solve such an inconvenience, Japanese Unexamined Patent Publication No. 2004-151470 discloses that a fixing roller 90 is comprised of a tubular temperature-sensitive metal layer 91 made of temperature-sensitive metal and a nonmagnetic metal layer concentrically placed on the outer circumferential surface of the temperature-sensitive metal layer 91 and made of nonmagnetic metal, and an induction coil 93 for creating a magnetism is arranged in the tubular temperature-sensitive metal layer 91 as shown in FIGS. 11A and 11B. In such a fixing roller 90, thickness t (m) of the temperature-sensitive metal layer 91 is set to satisfy the following inequality:

$$503\times\sqrt{(\rho/(\mu s\times f))} < t < 503\times\sqrt{(\rho(1\times f))}$$

(where ρ: resistivity (Ω·m) of the temperature-sensitive metal, f: frequency (Hz) of a power supply for the induction coil, μs: specific permeability at a temperature equal to or below a Curie temperature of the temperature-sensitive metal)

In this inequality, "$503\sqrt{(\rho/(\mu s\times f))}$" represents depth of magnetic permeation when the temperature of the temperature-sensitive metal layer 91 is equal to or below the Curie temperature (transition temperature), and "$503\sqrt{(\rho/(1\times f))}$" represents depth of magnetic permeation when the temperature of the temperature-sensitive metal layer 91 is above the Curie temperature.

By adopting the thus constructed fixing roller 90, the depth of magnetic permeation is smaller than the thickness of the temperature-sensitive metal layer 91 when the temperature of the temperature-sensitive metal layer 91 is equal to or below the Curie temperature. Thus, a load (electric resistance) caused by a resulting eddy current increases (i.e. an excess current density increases to increase the load due to the flow of a current in a narrow region), and the magnetism flows along longitudinal direction in the temperature-sensitive metal layer 91 having a large electric resistance as shown by arrows in FIG. 11A, whereby the temperature-sensitive metal layer 91 is quickly heated by a large amount of heat (Joule heat) produced by the load resulting from the eddy current.

If the temperature of the temperature-sensitive metal layer 91 exceeds the Curie temperature due to this heating, the depth of magnetic permeation becomes larger than the thickness of the temperature-sensitive metal layer 91. Thus, the magnetism reaches the nonmagnetic metal layer 92 having a smaller resistivity than the temperature-sensitive metal layer 91, and travels toward a direction of a center axis in the nonmagnetic metal layer 92 as shown in FIG. 11B, whereby the amount of produced heat is suppressed to suppress the overheating of the fixing roller 90.

Accordingly, if such a fixing roller 90 is adopted, there is an effect of being able to prevent the overheating of the fixing roller 90 without executing a control to detect the temperature of the fixing roller 90 by means of the temperature sensor such as a thermistor or a thermostat and to suppress the temperature of the fixing roller 90 (i.e. without any time lag caused by an output delay of the detection signal in the case of such a control).

In the fixing roller 90 disclosed in Japanese Unexamined Patent Publication No. 2004-151470, an alloy of iron (Fe) and nickel (Ni) is used for the temperature-sensitive metal layer 91 and aluminum (Al) is used for the nonmagnetic metal layer 92.

However, in the fixing device disclosed in Japanese Unexamined Patent Publication No. 2004-151470, heating efficiency by induction heating (particularly, temperature rising rate during the warm-up period) depends only on the characteristics of the temperature-sensitive metal (specifically, values of the specific resistivity and the permeability at a temperature equal to or below the Curie temperature). Therefore, there remains a problem of being unable to further improve the heating efficiency.

SUMMARY OF THE INVENTION

An object of the present invention is to provide a fixing device capable of shortening a warm-up period and reducing power consumption in consideration of induction heating and, in addition, capable of suppressing a nonuniform temperature variation of a fixing member, particularly an abnormal temperature rise at ends of the fixing member.

The present invention is directed to a fixing device, comprising a fixing member for thermally fixing a transferred toner image to a transfer material, and a pressing member held in contact with the fixing member to form a nip portion where the transfer material is caused to pass through, wherein the fixing member includes a nonmagnetic metal layer made of nonmagnetic metal; a temperature-sensitive metal layer made of temperature-sensitive metal; and an induction coil for induction heating by supplying magnetism toward the nonmagnetic metal layer and the temperature-sensitive metal layer, and the thickness of the nonmagnetic metal layer is set such that an amount of heat produced by the fixing member is larger than an amount of heat evolved singly in the temperature-sensitive metal layer.

In this fixing device, a warm-up period can be shortened and power consumption can be reduced in consideration of induction heating and, in addition, a nonuniform temperature variation of the fixing member, particularly an abnormal temperature rise at ends of the fixing member can be suppressed.

BRIEF DESCRIPTION OF THE DRAWINGS

FIGS. 5A and 5B are front views in section of a fixing member diagrammatically showing functions of the invention, wherein FIG. 5A shows a state where the temperature of a heating layer is below a Curie temperature and FIG. 5B shows a state where the temperature of the heating layer is equal to or above the Curie temperature.

FIGS. 10A and 10B are schematic diagrams of a fixing device according to a second embodiment of the invention, wherein FIG. 10A is a front view in section of the fixing device and FIG. 10B is an enlarged section of a fixing belt.

FIGS. 11A and 11B are diagrams showing induction heating of a conventional fixing roller, wherein FIG. 11 shows a case where the temperature of a fixing roller is below a Curie temperature and FIG. 11B shows a case where the temperature of the fixing roller is equal to or above the Curie temperature.

DESCRIPTION OF PREFERRED EMBODIMENTS

Figure 1:
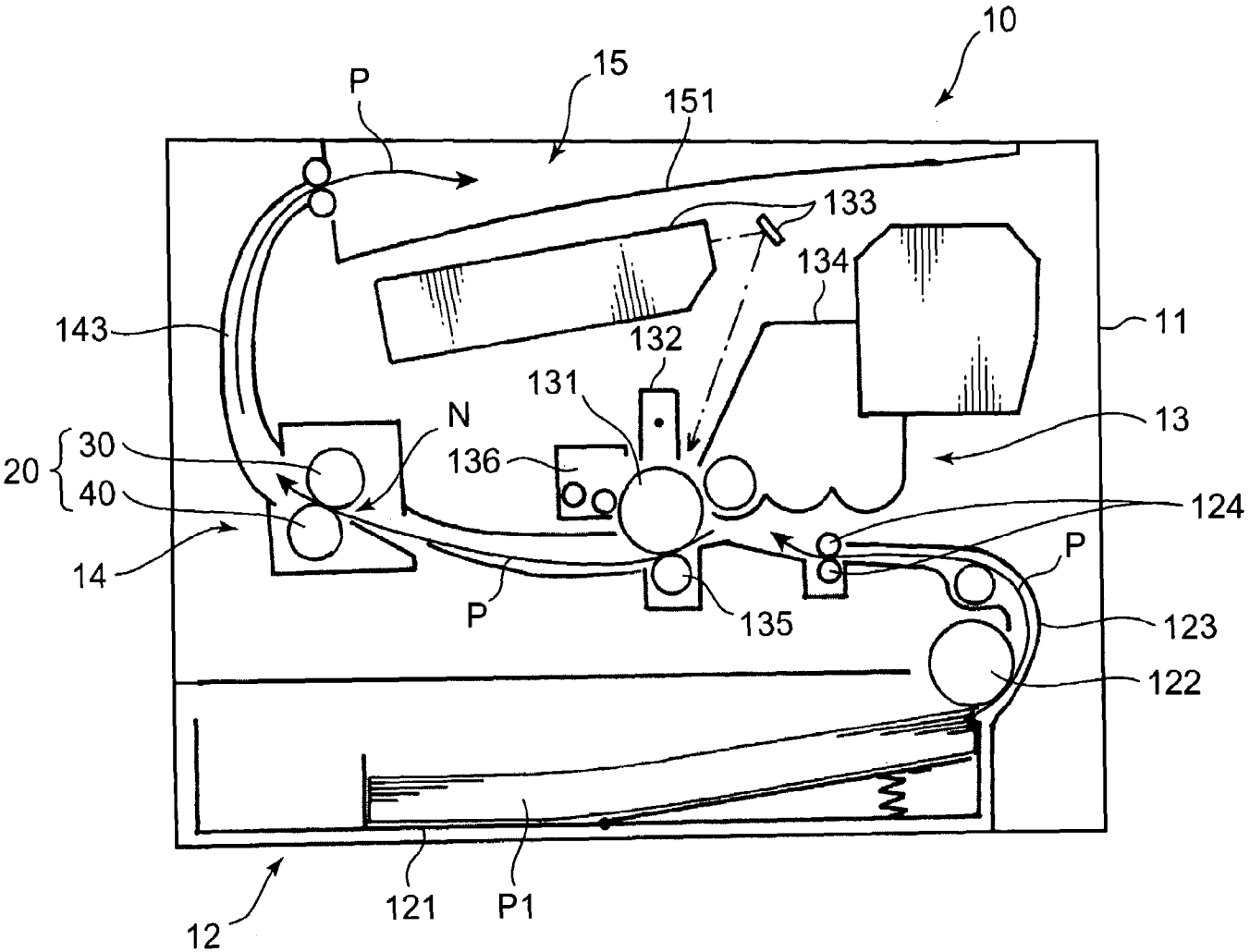
FIG. 1 is a front view in section schematically showing an internal construction of a printer provided with a fixing device according to a first embodiment of the invention.

First, a printer as one example of an image forming apparatus provided with a fixing device according to a first embodiment of the present invention is described with reference to FIG. 1. FIG. 1 is a front view in section schematically showing an internal construction of the printer provided with the fixing device according to the first embodiment. As shown in FIG. 1, a printer 10 is constructed such that a sheet storing unit 12 for storing sheets (transfer materials) P to be used for the printing, a transferring unit 13 for transferring images one by one to the sheets P dispensed from a sheet bundle P1 stored in the sheet storing unit 12, and a fixing unit 14 for fixing the image transferred to the sheet P in the transferring unit 13 to the sheet P are arranged in an apparatus main body 11 and a discharging unit 15 to which the sheet P having the image fixed thereto in the fixing unit 14 is discharged is arranged atop the apparatus main body 11.

The sheet storing unit 12 is provided with a specified number (one in FIG. 1) of sheet cassettes 121 detachably attachable to the apparatus main body 11. A pick-up roller for dispensing the sheets P one by one from the sheet bundle P1 is provided at the upstream end (right side in FIG. 1) of the sheet cassette 121. The sheet P dispensed from the sheet cassette 121 by driving the pick-up roller 122 is fed to the transferring unit 13 via a sheet conveyance path 123 and a pair of registration rollers 124 provided at the downstream end of the sheet conveyance path 123.

The transferring unit 13 is for transferring an image to the sheet P based on image information electrically transmitted from a computer or the like. A photosensitive drum 131 is so arranged as to be rotatable about a center axis thereof extending in forward and backward directions (directions normal to the plane of FIG. 1). A charging device 132, an exposing device 133, a developing device 134, a transfer roller 135 and a cleaning device 136 are arranged around the outer circumferential surface of the photosensitive drum 131 in this order in clockwise direction from a position right above the photosensitive drum 131.

The photosensitive drum 131 is for forming an electrostatic latent image and a toner image in conformity with the electrostatic latent image on the outer circumferential surface of the photosensitive drum 131, and an amorphous silicon layer is placed on the outer circumferential surface thereof. By the present of this amorphous silicon layer, the photosensitive drum 131 is suitable to have these images formed thereon.

The charging device 132 is for uniformly charging the outer circumferential surface of the photosensitive drum 131 rotating in clockwise direction. In an example shown in FIG. 1, the charging device 132 imparts electric charges to the outer circumferential surface of the photosensitive drum 131 by the corona discharge. In place of the charging device 132, a charging roller for imparting electric charges while being driven with the outer circumferential surface thereof held in contact with the outer circumferential surface of the photosensitive drum 131 may be used as a member for imparting electric charges to the outer circumferential surface of the photosensitive drum 131.

The exposing device 133 is for emitting a modulated laser beam based on an image data electrically transmitted from an external apparatus such as a computer to the outer circumferential surface of the rotating photosensitive drum 131, whereby the electric charges in parts of the outer circumferential surface of the photosensitive drum 131 where the laser beam was incident are removed to form an electrostatic latent image on the outer circumferential surface of the photosensitive drum 131.

The developing device 134 is for forming a toner image on the outer circumferential surface of the photosensitive drum 131 by supplying toner to the outer circumferential surface of the photosensitive drum 131 and attaching the toner to the parts of the outer circumferential surface where the electrostatic latent image is formed.

The transfer roller 135 is for transferring the positively charged toner image formed on the outer circumferential surface of the photosensitive drum 131 to the sheet P fed up to a position right below the photosensitive drum 131 by imparting negative electric charges having a polarity opposite to the electric charges of the toner image to the sheet P.

Accordingly, while the sheet P having reached the position immediately below the photosensitive drum 131 is pressingly held between the transfer roller 135 and the photosensitive drum 131, the positively charged toner image on the outer circumferential surface of the photosensitive drum 131 is peeled off toward the front surface of the negatively charged sheet P, whereby the toner image is transferred to the sheet P.

The cleaning device 136 is for cleaning the outer circumferential surface of the photosensitive drum 131 after the image transfer by removing the toner residual on this outer circumferential surface. The outer circumferential surface of the photosensitive drum 131 cleaned by this cleaning device 136 is moved toward the charging device 132 for a next image forming operation.

The fixing unit 14 is for fixing the toner image transferred to the sheet P by the transferring unit 13 to the sheet P by heating and includes a fixing device 20 comprised of a fixing member 30 for applying heat to the sheet P and a pressing member 40 opposed to the fixing member 30 from below. The sheet P after the image transfer is fed toward a nip portion N defined between the fixing member 30 and the pressing member 40 and has the toner image fixed thereto upon receiving the heat from the fixing member 30 while passing through the nip portion N. The sheet P having the toner image fixed thereto is discharged to the discharging unit 15 via a sheet discharging path 143.

The discharging unit 15 is formed by recessing the top of the apparatus main body 11, and a discharge tray 151 for receiving the discharged sheet P is formed at the bottom of this recessed part.

Figure 2:
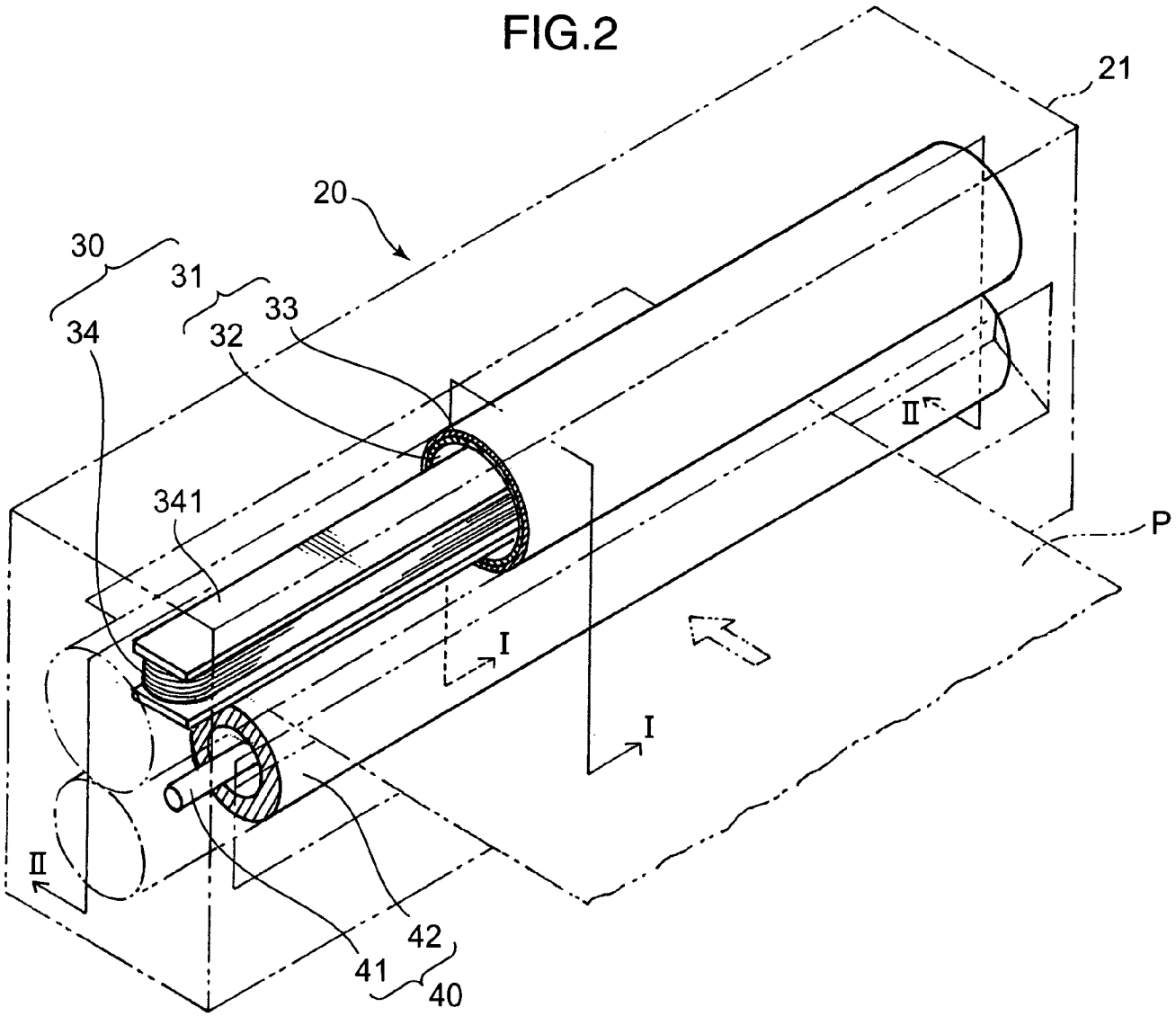
FIG. 2 is a perspective view partly in section showing the fixing device according to the first embodiment.
Figure 3:
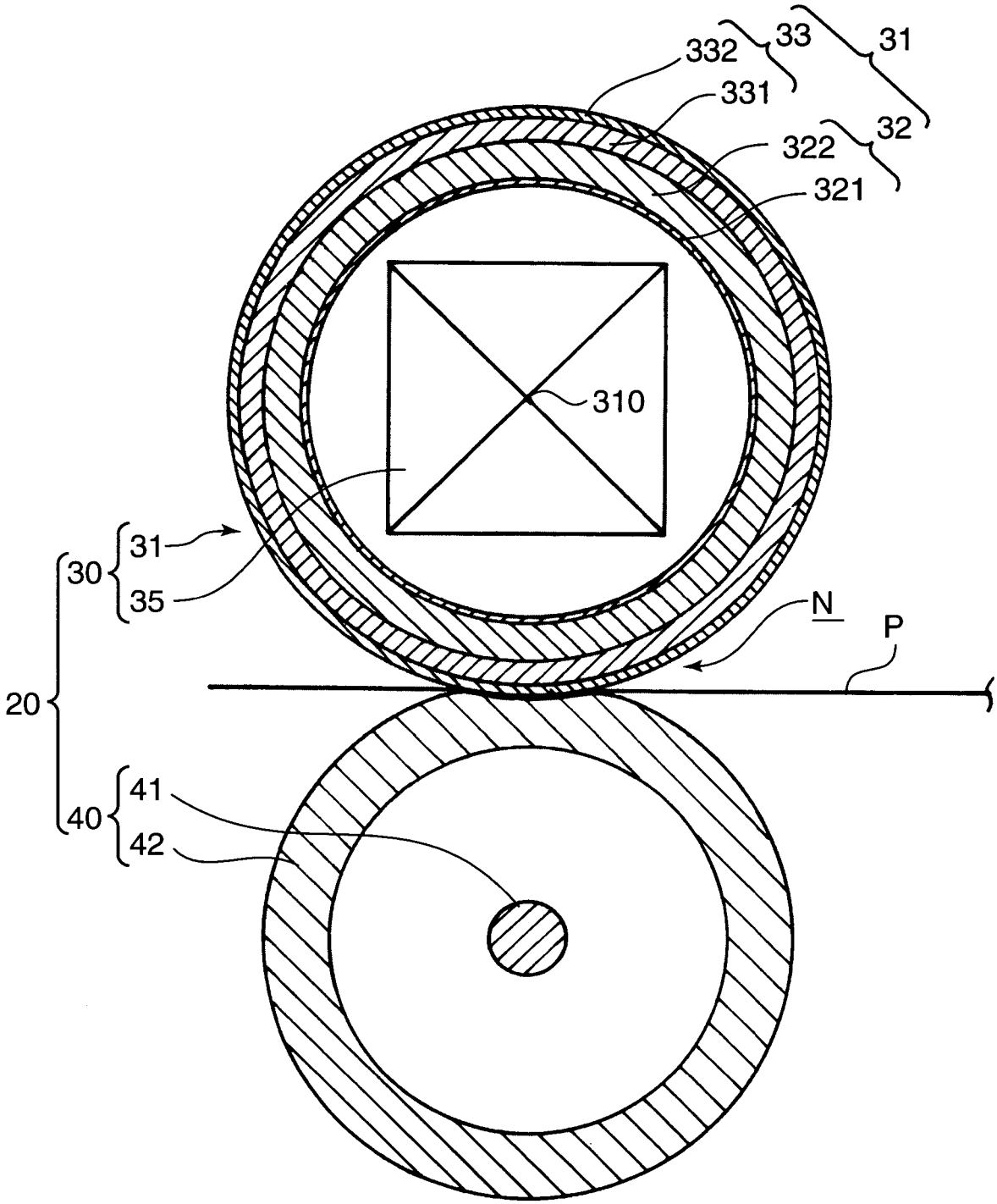
FIG. 3 is a section along I-I of FIG. 2.
Figure 4:
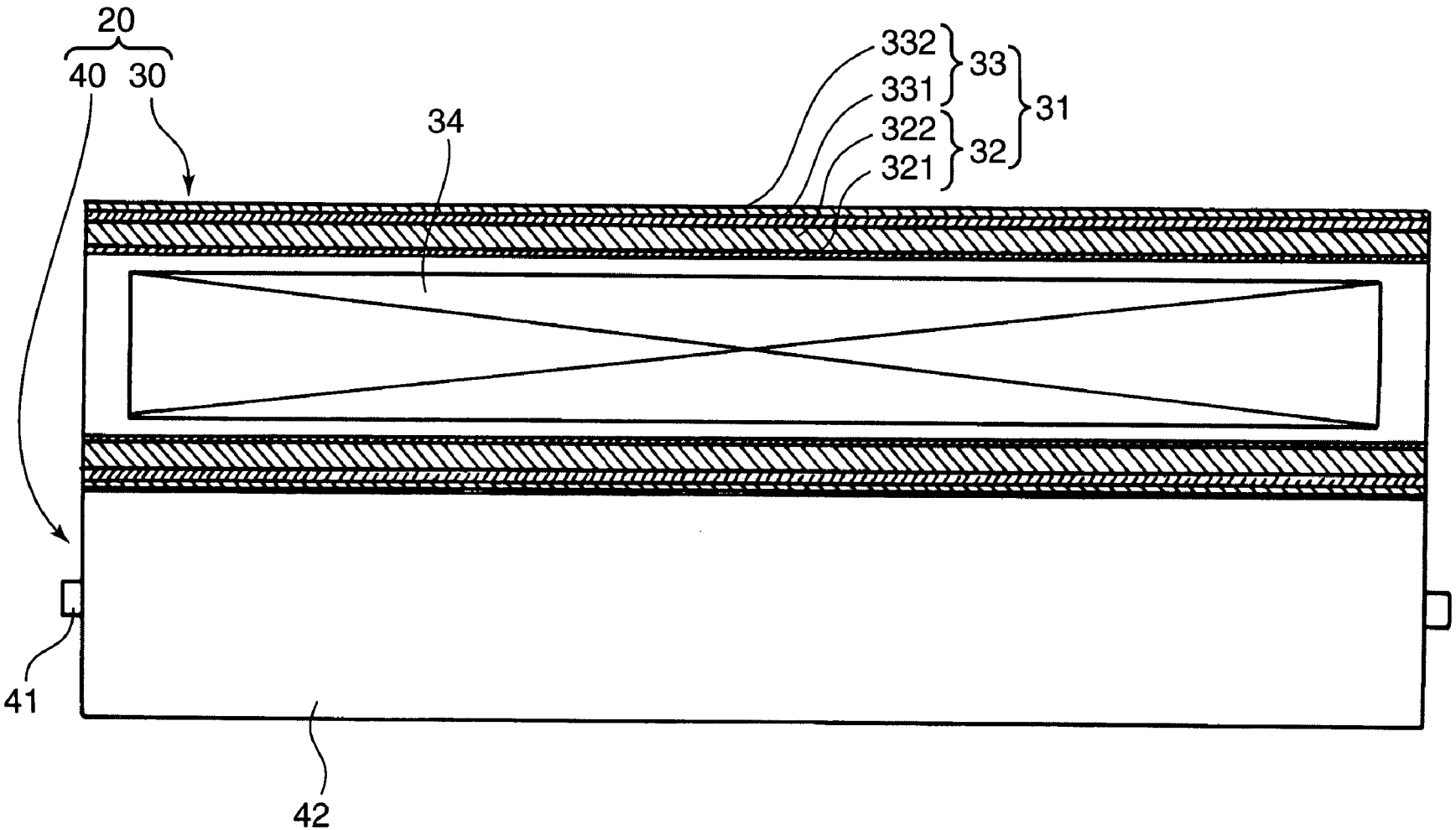
FIG. 4 is a section along II-II of FIG. 2.

FIG. 2 is a schematic perspective view partly in section showing the fixing device according to the first embodiment of the present invention, FIG. 3 is a section along I-I of FIG. 2 and FIG. 4 is a section along II-II of FIG. 2. In FIGS. 2 to 4, the thicknesses of a fixing roller 31 and a pressure roller shaft 41 are shown in an exaggerated manner. As shown in FIG. 2, the fixing device 20 is formed by mounting the fixing member 30 and the pressing member 40 into a box-shaped casing 21.

The fixing member 30 includes the tubular fixing roller 31 mounted at an upper position in the casing 21 and an induction coil 34 provided in this fixing roller 31. The fixing roller 31 is rotatably mounted about a tube axis 310 (see FIG. 3) extending in a sheet width direction orthogonal to a sheet conveying direction (shown by an outline arrow in FIG. 2) in an upper part of the casing 21. Such a fixing roller 31 is driven in clockwise direction about the tube axis 310 by an unillustrated drive motor provided outside the casing 21. Although the outer diameter of the fixing member 30 is set at 40 mm in this embodiment, it is not particularly limited to 40 mm and an optimal outer diameter may be set depending on the situation.

The pressing member 40 is disposed in parallel with the fixing roller 31 in a lower part of the casing 21 such that the outer circumferential surface thereof is in contact with that of the fixing roller 31. Such a pressing member 40 includes a pressure roller shaft 41 extends rotatably about the center axis thereof between the opposite side walls of the casing 21, and a pressure roller 42 concentrically supported on the pressure roller shaft 41 so as to be rotatable about this shaft 41.

The pressure roller 42 is made of elastomer such as a silicon rubber, wherefore the outer circumferential surface of the pressure roller 42 is elastically deformed radially inward while being pressed into contact with the outer circumferential surface of the fixing roller 31 as shown in FIG. 3. The pressure roller 42 is driven as the fixing roller 31 rotates about the tube axis 310. The nip portion N where the nipped sheet P is caused to pass through is formed at a position where the pressure roller 42 is in contact with the fixing roller 31. Accordingly, with the fixing roller 31 and the pressure roller 42 rotated in opposite directions, the sheet P fed from the transferring unit 13 is heated by the fixing roller 31 while having the front surface thereof pressed against the fixing roller 31 by the elastically deformed pressure roller 42 and passing through the nip portion N. In this way, the image fixing operation is performed by attaching the melted toner to the front surface of the sheet P.

Figure 5A:
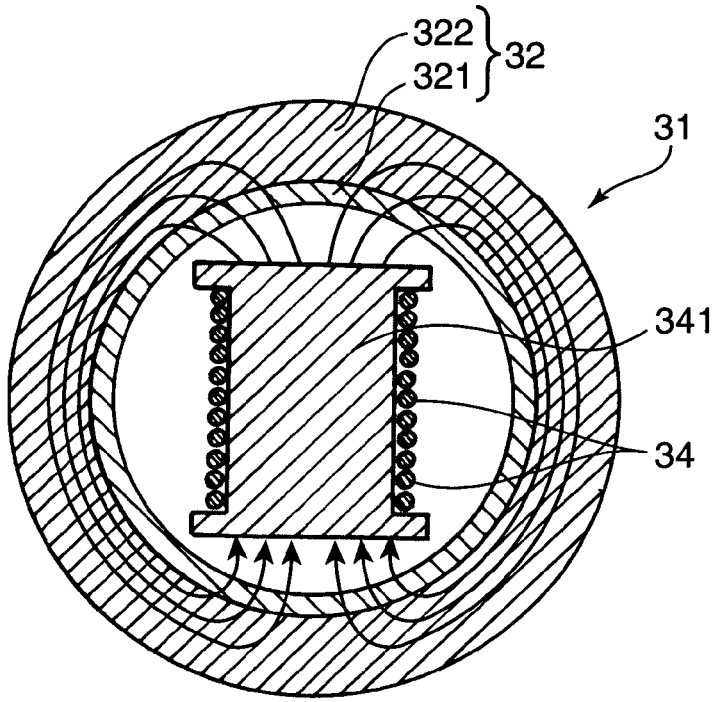
Figure 5B:
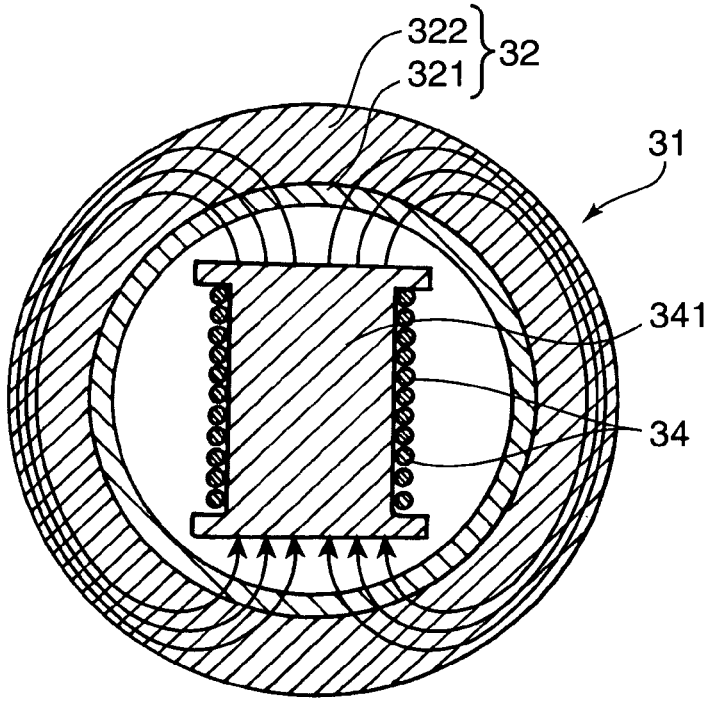

The induction coil 34 is wound in longitudinal direction between upper and lower jaw portions of a core 341 made of magnetic material and mounted to extend in longitudinal direction within the fixing roller 31 as shown in FIG. 2. Power from an unillustrated high-frequency generating circuit as a power supply for induction heating is supplied to such an induction coil 34. By the supply of the power to the induction coil 34, fluxes of magnetic lines (magnetic fluxes) outputted from one jaw portion of the core 341 of the induction coil 34 travel toward the other jaw portion in the fixing roller 31 as shown in FIGS. 5A and 5B. An eddy current occurs in the fixing roller 31 by the flow of such magnetic fluxes and the fixing roller 31 is heated by the resulting Joule heat.

The fixing roller 31 has a metal layer 32 for heating the fixing roller 31 by induction heating and a resin layer 33 placed on the outer circumferential surface of the metal layer 32. The resin layer 33 is provided to protect the outer circumferential surface of the metal layer 32 and to ensure a good parting property for the sheet P, and is comprised of an elastic layer 331 made of elastic material such as silicon rubber and a parting layer 332 made of PFA (tetrafluoroethylene-perfluoroalkyl vinylether copolymer) or the like placed on the outer circumferential surface of the elastic layer 331. In this embodiment, the thickness of the elastic layer 331 is set at about 100 μm and that of the parting layer 332 is set at about 50 μm.

As shown in FIGS. 3 and 4, the metal layer 32 is comprised of an annular nonmagnetic metal layer 321 made of nonmagnetic metal and a temperature-sensitive metal layer 322 made of temperature-sensitive metal and placed on the outer circumferential surface of the nonmagnetic metal layer 321. In this embodiment, any of copper, aluminum and nonmagnetic stainless steel is used as the nonmagnetic metal.

The temperature-sensitive metal is a metal whose magnetic characteristic changes with temperature, and an alloy of iron (Fe) and nickel (Ni) is used as such in this embodiment. Such a temperature-sensitive metal has a property of changing the depth of magnetic permeation at a magnetic transition temperature (Curie temperature) at which the magnetic characteristics change. In this embodiment, the Curie temperature is set at about 200° C. by adjusting the alloy ratio of iron (Fe) and nickel (Ni) as the components of the temperature-sensitive metal. No Curie temperature exists for nonmagnetic metals because these metals are not magnetic.

In the present invention, it is designed to speed up a warm-up period for the heating of the fixing roller 31 and to reduce power consumption by utilizing both Joule heat produced by the magnetic fluxes permeating the nonmagnetic metal layer 321 provided at a side toward the induction coil 34 and Joule heat evolved in the temperature-sensitive metal layer 322 by the magnetic fluxes having permeated the nonmagnetic metal layer 321.

The depth of magnetic permeation of a metal, which fulfills an essential role in the present invention, is described below. The depth of magnetic permeation of the metal is expressed by the following equation (i).

$$\sigma = 503 \times \sqrt{(\rho/(\mu \times f))} \quad \text{(i)}$$

(where σ: depth of magnetic permeation (m), ρ: specific resistance (Ω·m), f: frequency (Hz) of a power supply for induction heating, μ: specific permeability (at a temperature equal to or below a Curie temperature in the case of a temperature-sensitive metal)

The equation (i) holds regardless of whether the metal is a nonmagnetic metal or a temperature-sensitive metal. Particularly, in the case where the metal is a temperature-sensitive metal, this equation (i) holds when the temperature of the temperature-sensitive metal is equal to or below the Curie temperature. In the case of a temperature above the Curie temperature, the depth of magnetic permeation a is defined by the following equation (ii).

As can be seen from the equation (i), the depth of magnetic permeation σ is proportional to a square of the specific resistivity ρ of the metal while being inversely proportional to squares of the specific permeability μ and the frequency f of the power supply for induction heating. Accordingly, the larger the specific resistance ρ of the metal, the larger the depth of magnetic permeation σ, whereas the larger the specific permeability μ and the frequency f, the smaller the depth of magnetic permeation σ. Normally, the value of the specific permeability μ at a temperature equal to or below the Curie temperature of the metal is considerably larger than 1.

On the other hand, in the case of a temperature-sensitive metal, the depth of magnetic permeation σ of this temperature-sensitive metal above the Curie temperature is expressed by the following equation (ii).

$$\sigma = 503 \times \sqrt{(\rho/(1 \times f))} \quad \text{(ii)}$$

(where σ: depth of magnetic permeation (m), ρ: specific resistance (Ω·m), f: frequency (Hz) of a power supply for induction heating, μ=1: specific permeability at a temperature equal to or the Curie temperature of the temperature-sensitive metal).

Specifically, if the temperature of the temperature-sensitive metal exceeds the Curie temperature, the specific permeability μ takes a minimum value of "1", wherefore the depth of magnetic permeation σ increases. In this embodiment, the frequency f of the power supply for induction heating is set at 30 kHz.

Next, the load of an eddy current caused by the presence of a metal in a magnetic field is described. An eddy current load R is expressed by the following equation (iii).

$$R = \rho/z \quad \text{(iii)}$$

(where R: eddy current load (Ω), ρ: specific resistance (Ω·m), z: eddy current occurring depth (m)).

Specifically, the eddy current load R is proportional to the specific resistance ρ while being inversely proportional to the eddy current occurring depth z. Thus, it holds for metals having the same specific resistance ρ that the larger the eddy current occurring depth z, the smaller the eddy current load R.

On the other hand, if thickness d of the metal is smaller than the eddy current occurring depth z (i.e. the depth of magnetic permeation σ), the eddy current load R is expressed by the following equation (iv).

$$R = \sigma/d \quad \text{(iv)}$$

(where d: thickness of the metal (d<z=σ)

TABLE-1 shows eddy current loads R of nonmagnetic metals and magnetic metals in the case where the thickness d of the metal is larger than the depth of magnetic permeation σ (d>σ), i.e. in a state where the thickness d is no judging factor. It should be noted that the frequency f of the power supply for induction heating is set at 30 kHz.

TABLE 1

EDDY CURRENT LOADS OF NONMAGNETIC METALS AND MAGNETIC METALS (f=30 kHz, d > z)

| | NONMAGNETIC METALS | | | MAGNETIC METALS | |
|---|---|---|---|---|---|
| | COPPER | ALUMINUM | SUS304 | IRON | NICKEL |
| SPECIFIC RESISTANCE ρ(Ω · m) | $1.67 \times 10^{-8}$ | $2.66 \times 10^{-8}$ | $7.20 \times 10^{-7}$ | $9.71 \times 10^{-8}$ | $6.80 \times 10^{-8}$ |
| DEPTH OF MAGNETIC PERMEATION z(m) | $3.75 \times 10^{-4}$ | $4.74 \times 10^{-4}$ | $2.46 \times 10^{-3}$ | $4.05 \times 10^{-5}$ | $4.37 \times 10^{-5}$ |
| EDDY CURRENT LOAD (Ω) | $4.45 \times 10^{-5}$ | $5.62 \times 10^{-5}$ | $2.92 \times 10^{-4}$ | $2.40 \times 10^{-3}$ | $1.56 \times 10^{-3}$ |
| HEATING BY JOULE HEAT | IMPOSSIBLE | IMPOSSIBLE | POSSIBLE (BUT POOR EFFICIENCY) | POSSIBLE | POSSIBLE |

As can be seen from TABLE-1, the depth of magnetic permeation σ of nonmagnetic metals such as copper (Cu), aluminum (Al) and nonmagnetic stainless steel (SUS304) are fairly larger than magnetic metals. Thus, the eddy current loads R of the nonmagnetic metals, which are values obtained by dividing the values of the specific resistance ρ differing only by about one digit between the nonmagnetic metals and the magnetic metals by the values of the depth of magnetic permeation σ, are considerably smaller as compared to the magnetic metals, wherefore induction heating is possible using the nonmagnetic metals, but heating efficiency is poor. Accordingly, upon induction heating using a nonmagnetic metal, it is a common practice to increase the frequency f of the power supply for induction heating up to 200 kHz, thereby reducing the depth of magnetic permeation a (see equations (i) and (ii)), but this considerably increases the cost for the power supply (power cost).

Accordingly, in the present invention, the thickness d of the nonmagnetic metal layer 321 is sufficiently thinned, paying attention to the equation (iv), and it is designed to ensure quick heating during the warm-up period of the fixing roller 31 by combining the heating resulting from the increased eddy current load R and the heating by the Joule heat produced by the magnetic fluxes having permeated the nonmagnetic metal layer 321 in the temperature-sensitive metal layer 322 and to prevent the overheating of the fixing roller 31.

In order to prevent an excessive temperature rise of the fixing roller 31, the present invention utilizes such a property that the specific permeability μ of the temperature-sensitive metal layer 322 takes a minimum value of "1" if the temperature thereof exceeds the Curie temperature (i.e. a property that the value of the depth of magnetic permeation σ calculated by the equation (ii) when the value of the specific permeability μ is "1" is considerably larger than the one calculated by the equation (i) when the value of the specific permeability μ is considerably larger than "1") (i.e. utilizes such a property that the value of the eddy current load R decreases to reduce an amount of Joule heat as the depth of magnetic permeation σ becomes larger) and such a normal circuit construction of the unillustrated high-frequency power supply for supplying a high-frequency power to the induction coil 34 to detect the variation of a large load given to the temperature-sensitive metal layer 322 when the temperature of the temperature-sensitive metal layer 322 becomes equal to or above the Curie temperature and to stop the power supply to the induction coil 34 based on this detection result.

Specifically, if the temperature-sensitive metal layer 322 is heated to a temperature equal to or above the Curie temperature, the specific permeability μ thereof becomes "1" to considerably reduce the eddy current load R thereof, wherefore an excessively large current is supplied to the induction coil 34 (such a state is set as if a short circuit has occurred in a specified circuit of the high-frequency power supply) while the amount of Joule heat evolved in the temperature-sensitive metal layer 322 is reduced. Such a sudden and considerable current increase is detected and the power supply to the induction coil 34 from the high-frequency power supply is temporarily shut off. In this way, the overheating of the fixing roller 31 can be prevented.

TABLE-2 shows various data concerning the induction heating and values of the eddy current loads R for cases where the temperature of the temperature-sensitive metal layer 322 made of an alloy containing 60% of iron (Fe) and 40% of nickel (Ni) is below and above or equal to the Curie temperature.

TABLE 2

EDDY CURRENT LOADS OF TEMPERATURE-SENSITIVE METALS

| | (1) (TEMPERATURE-SENSITIVE METAL LAYER: ALLOY OF Fe(60%) + Ni(40%)) | | | | |
|---|---|---|---|---|---|
| (2) | SPECIFIC RESISTANCE ρ(Ω · m) | SPECIFIC PERMEABILITY μ | POWER SUPPLY FREQUENCY f(kHz) | DEPTH OF MAGNETIC PERMEATION σ(mm) | EDDY CURRENT LOAD R(Ω) |
| <CURIE TEMP. | $6.0 \times 10^{-7}$ | 10000 | 30 | 0.0225 | $2.67 \times 10^{-2}$ |
| ≧CURIE TEMP. | $6.0 \times 10^{-7}$ | 1 | 30 | 2.25 | $2.67 \times 10^{-4}$ |

(1) PHYSICAL PROPERTIES OF TEMPERATURE SENSITIVE METAL
(2) TEMPERATURE OF TEMPERATURE-SENSITIVE METAL

As can be seen from TABLE-2, if the temperature of the temperature-sensitive metal layer 322 is below the Curie temperature, the specific permeability μ takes a fairly large value of 10000. Thus, the depth of magnetic permeation σ takes a value of 0.0225 mm ($2.25\times10^{-5}$ m) and the eddy current load R takes a value of $2.67\times10^{-2}\Omega$ ($6.0\times10^{-7}/2.25\times10^{-5}$) in accordance with the above equation (iii) if the frequency f of the power supply for induction heating is set at 30 kHz. On the contrary, if the temperature of the temperature-sensitive metal layer 322 is equal to or above the Curie temperature, the specific permeability μ takes a larger value of 2.25 mm ($2.25\times10^{-3}$ m), wherefore the eddy current load R takes a value of $2.67\times10^{-4}\Omega$ ($6.0\times10^{-7}/2.25\times10^{-3}$) which is 1/100as compared to the former case.

The thickness of such a temperature-sensitive metal layer 322 is set at 200 μm in view of a standard that such a thickness is necessary that a total eddy current load ΣR of the nonmagnetic metal layer 321 and the temperature-sensitive metal layer 322 at a temperature equal to or above the Curie temperature of the temperature-sensitive metal is equal to or below about 50% of a total eddy current load ΣR' of the nonmagnetic metal layer 321 and the temperature-sensitive metal layer 322 at a temperature below the Curie temperature of the temperature-sensitive metal (ΣR/ΣR'<about 0.5) (this standard is empirically obtained from actual operations relating to the shutoff of the power supply to the induction coil 34 in the case where the temperature of the temperature-sensitive metal layer 322 exceeds the Curie temperature) Since ΣR is $1.58\times10^{-3}$ and ΣR' is $2.97\times10^{-3}$ when the thickness of the temperature-sensitive metal layer 322 is 200 μm, "ΣR/ΣR'=0.53".

FIGS. 5A and 5B are front views in section of the fixing member diagrammatically showing functions of the invention, wherein FIG. 5A shows a state where the temperature of the metal layer 32 is below the Curie temperature and FIG. 5B shows a state where the temperature of the metal layer 32 is equal to or above the Curie temperature. It should be noted that the resin layer 33 is not shown and the thickness of the metal layer 32 is exaggerated in FIGS. 5A and 5B.

First, in the state shown in FIG. 5A where the temperature of the metal layer 32 is below the Curie temperature, magnetism from the induction coil 34 comes out from one end of the core 341, permeates through the thin nonmagnetic metal layer 321, travels in the temperature-sensitive metal layer 322 at a shallow depth of permeation a calculated by the equation (i) (see column "<Curie Temperature" of TABLE-2), permeates through the nonmagnetic metal layer 321 again and returns to the other end of the core 341. Thus, the metal layer 32 is heated by the Joule heat produced by the large eddy current load R calculated by the equation (iv) and the Joule heat produced by the large eddy current load R in the temperature-sensitive metal layer 322, whereby the temperature of the metal layer 32 quickly rises during the warm-up period.

Subsequently, when the temperature of the metal layer 32 exceeds 200° C. set as the Curie temperature, the depth of permeation σ of the magnetism from the induction coil 34 (see the column "≧Curie Temperature" of TABLE-2) increases about 100 times as compared to the case where the temperature of the metal layer 32 is below the Curie temperature, whereby the eddy current load R becomes about 1/100as compared to the case where the temperature of the metal layer 32 is below the Curie temperature. As a result, the eddy current caused by the magnetism from the induction coil 34 superfluously flows in the temperature-sensitive metal layer 322 as shown in FIG. 5B, whereby there is almost no Joule heating in the temperature-sensitive metal layer 32. In this state, an excessive current is supplied to the induction coil 34 from the high-frequency power supply and the power supply to the induction coil 34 is automatically shut off based on the excessive current supply. Therefore, the overheating of the fixing roller 31 at a temperature considerably exceeding the Curie temperature can be securely prevented.

Thereafter, when the temperature of the metal layer 32 falls below 200° C. as the Curie temperature, the power supply to the induction coil 34 from the high-frequency power supply is automatically resumed. Thus, the supplied state of the magnetism from the induction coil 34 returns to the state shown in FIG. 5A and the heating by the Joule heat is carried out in the temperature-sensitive metal layer 321 again.

By repeating the heating and cooling of the fixing roller 31 by switching the magnetic flux passages below and above the Curie temperature in this way, a temperature control varying within a permissible range can be realized for the fixing roller 31 even without executing a feedback control using a temperature sensor. This can contribute to a reduction in the production cost of the device.

In the present invention, the effective thicknesses of the nonmagnetic metal layer 321 and the temperature-sensitive metal layer 322 in quickly heating the fixing roller 31 and preventing the overheating were found out. Specifically, the thickness of the nonmagnetic metal layer 321 is set such that the amount of heat produced by the fixing roller 31 is larger than the amount of heat produced singly by the temperature-sensitive metal layer 322. In other words, the amount of heat produced by the fixing roller 31 depends on the value of the aforementioned eddy current load and decreases if the eddy current load of the temperature-sensitive metal layer 322 is too high. On the other hand, the eddy current load of the nonmagnetic metal layer 321 is low. Thus, if the eddy current load of the temperature-sensitive metal layer 322 is improper, the eddy current load can be set at a value that will give the best heating efficiency when the nonmagnetic metal layer 321 and the temperature-sensitive metal layer 322 are combined by attaching the nonmagnetic metal layer 321 of a suitable thickness in conformity with the material thereof to the temperature-sensitive metal layer 322. The nonmagnetic metal layer 321 can function as an adjusting layer, so to speak, for making the eddy current load proper, whereby the amount of heat produced by the fixing roller 31 can be made larger than the one produced singly by the temperature-sensitive metal layer 322.

The effective thicknesses of the nonmagnetic metal layer 321 and the temperature-sensitive metal layer 322 are described in detail below with reference to FIG. 6.

Figure 6:
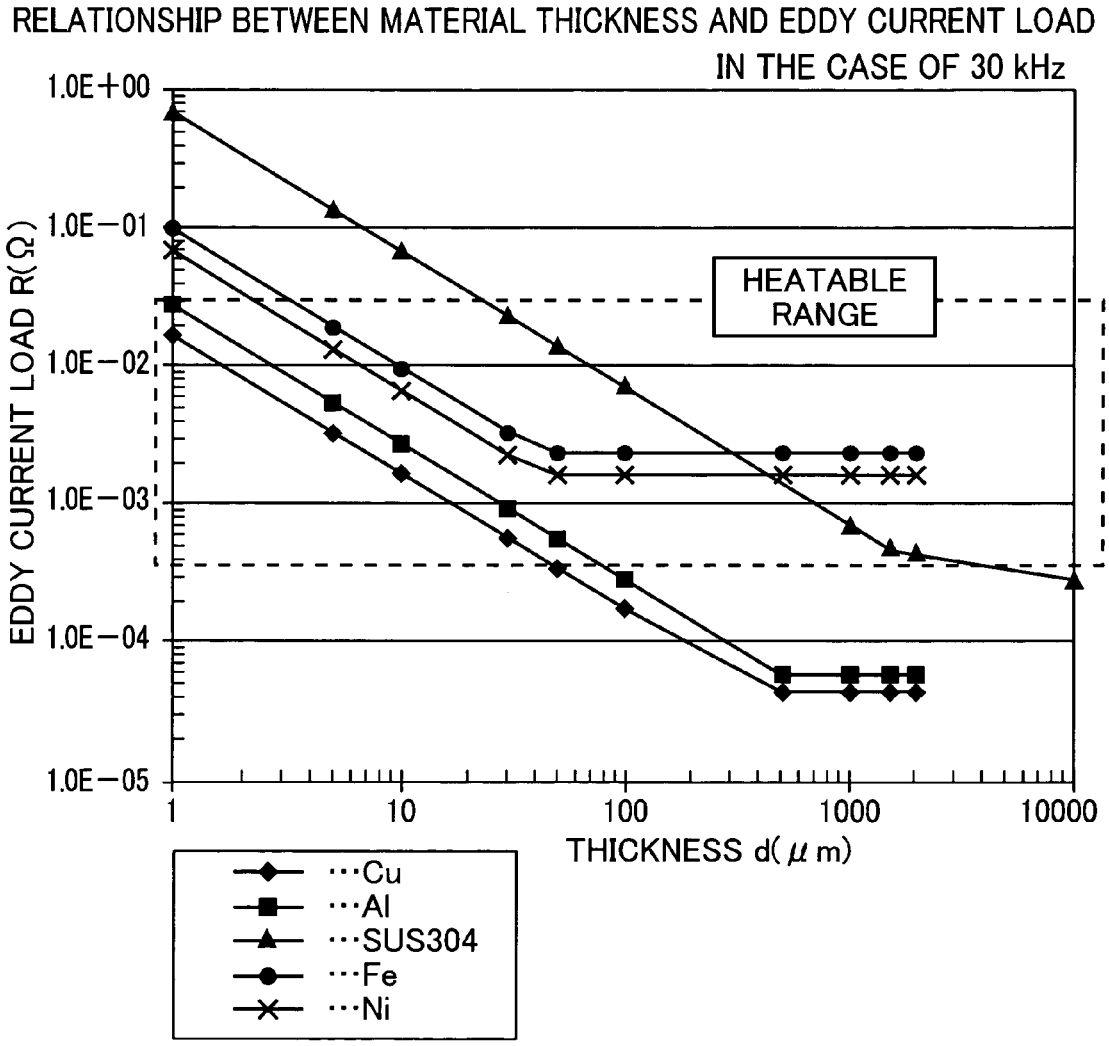
FIG. 6 is a double logarithmic graph showing thickness-eddy current load relationships of various materials for the heating layer of the fixing roller when the frequency of a power supply for induction heating is 30 kHz.

FIG. 6 is a double logarithmic graph showing relationships between thicknesses d of various materials for the metal layer 32 of the fixing roller 31 and the eddy current load R in the case where the frequency f of the power supply for induction heating is 30 kHz. In this graph, horizontal axis represents the thickness d (μm) in logarithmic scale and vertical axis represents the eddy current load R (Ω, where a scale value "1.0E-i" indicates "$1.0\times10^{-i}$") in logarithmic scale. In this graph, black rhombi, black rectangles and black triangles respectively represent copper (Cu), aluminum (Al) and stainless steel (SUS304), which are nonmagnetic metals, and black circles and crosses (×) respectively represent iron (Fe) and nickel (Ni), which are temperature-sensitive metals.

Further, in this graph, lines representing the relationships between the thicknesses d of the various materials and the eddy current load R are obtained by plotting actual measurement values, and the aforementioned equations (iii), (iv) are derived from these lines.

A range enclosed by dotted line in the graph of FIG. 6 (range from $2.0\times10^{-4}$ to $2.0\times10^{-2}$ with respect to the eddy current load R) is set as a range where induction heating can be effectively carried out. Such a range is set for the following reasons.

Specifically, if the eddy current load R is below $2.0\times10^{-4}\Omega$, the resistance value of the metal layer 32 does not largely differ from that of the induction coil 34 and is too small a value to produce the Joule heat, wherefore the metal layer 32 cannot be sufficiently heated. Contrary to this, if the eddy current load R exceeds $2.0\times10^{-2}\Omega$, the resistance value is too large, making it difficult to produce an eddy current due to the relationship with an amount of current the high-frequency power supply can supply, wherefore no Joule heat can be substantially obtained. Such a heatable range by the eddy current load R was obtained by conducting various experiments.

It was found out that the range of the eddy current load R of the nonmagnetic metal layer 321 is preferably equal or above $2.4\times10^{-3}\Omega$, and particularly preferably between $2.8\times10^{-3}\Omega$ to $8.0\times10^{-3}\Omega$.

TABLE-3 shows thickness values for the respective materials converted from the values of these eddy current loads R.

TABLE 3

| KIND OF NONMAGNETIC METAL | PREFERABLE THICKNESS RANGE (μm) | PARTICULARLY PREFERABLE THICKNESS RANGE (μm) |
|---|---|---|
| Copper (Cu) | ≦7.0 | 2.0 to 6.0 |
| Aluminum (Al) | ≦11.1 | 3.3 to 9.5 |
| Stainless Steel (SUS304) | ≦300 | 90 to 257 |

In TABLE-3, for example, a numerical value of "7.0" of the preferable thickness range "≦7.0 μm" is a value obtained by dividing the value of the specific resistance of copper (Cu), i.e. $1.67\times10^{-8}$ Ωm (see TABLE-1) by the value of the eddy current load R of the copper (Cu), i.e. $2.4\times10^{-3}\Omega$ in accordance with the equation (iv) ($d=1.67\times10^{-8}\ \Omega m/2.4\times10^{-3}\Omega=7.0\times10^{-6}$). In similar manners, the numerical values of the particularly preferable thickness range of copper (Cu) and those of the thickness ranges of aluminum (Al) and stainless steel (SUS304) are calculated.

Figure 8:
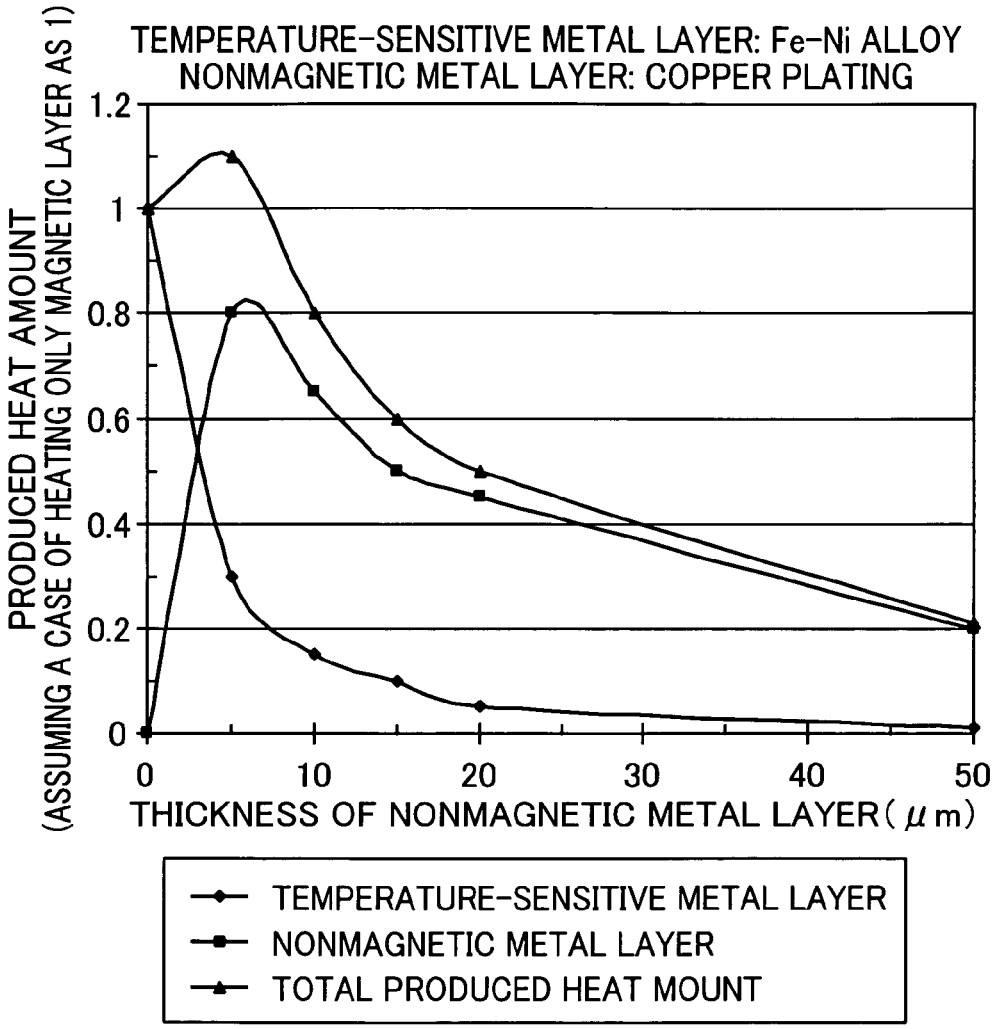
FIG. 8 is a graph showing relationships between the thickness of a nonmagnetic metal layer made of copper and an amount of Joule heat evolved in a heating layer comprised of a nonmagnetic metal layer and a temperature-sensitive metal layer at a temperatures equal to or below the Curie temperature.

Next, the grounds for the preferable thickness range of the nonmagnetic metal layer 321 are described with reference to FIG. 8, taking copper (Cu) as an example. FIG. 8 is a graph showing relationships between the thickness of the nonmagnetic metal layer 321 made of copper (Cu) and the amount of Joule heat produced by the metal layer 32 comprised of the nonmagnetic metal layer 321 and the temperature-sensitive metal layer 322 when the temperature of the metal layer 32 is equal to or below the Curie temperature.

In this graph, horizontal axis represents the thickness (μm) of the nonmagnetic metal layer 321 and vertical axis represents a ratio of the amount of Joule heat produced by the metal layer 32 to that produced singly by the temperature-sensitive metal layer 322 with the latter amount as 1. The case where only the temperature-sensitive metal layer 322 is heated to produce Joule heat is a state where no nonmagnetic metal layer 321 is placed on the temperature-sensitive metal layer 322. The thickness of the temperature-sensitive metal layer 322 is set at 250 μm considerably larger than 22.5 μm, which is the depth of magnetic permeation at a temperature equal to or below the Curie temperature.

Figure 7:
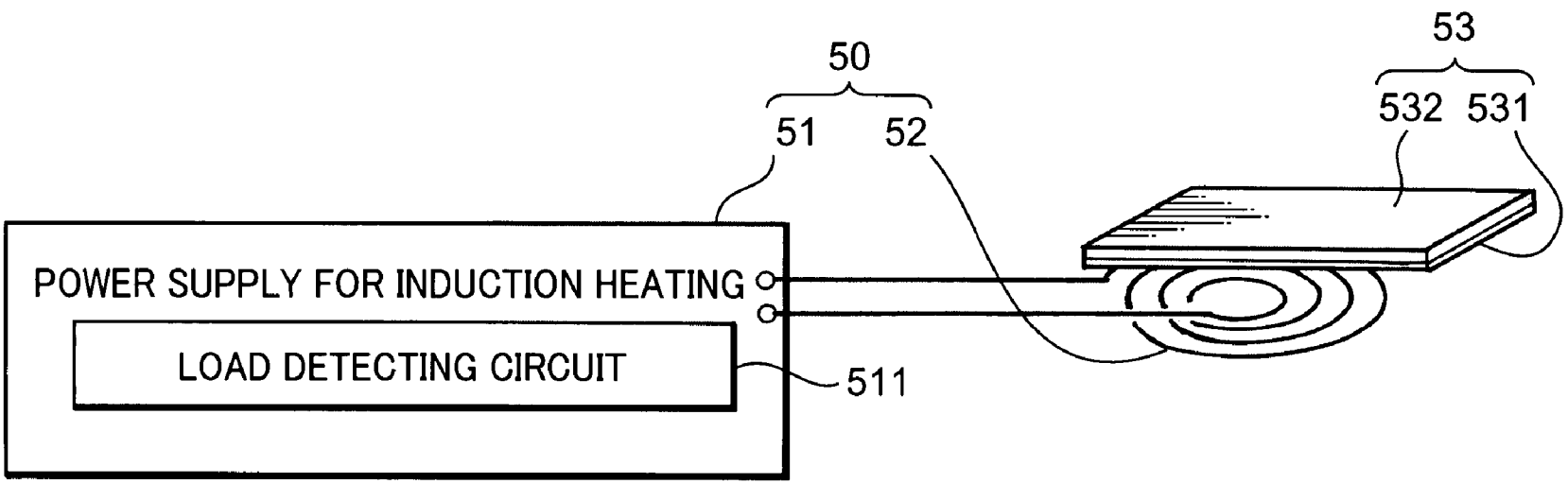
FIG. 7 is a diagram schematically showing a testing apparatus.

This graph is obtained as a result of a test using a testing apparatus as shown in FIG. 7. A testing apparatus 50 is provided with a power supply 51 for induction heating having a built-in load detecting circuit 511, and an induction heating coil 52 for producing high-frequency magnetic forces by the power supplied from the power supply 51 as shown in FIG. 7. In such a testing apparatus 50, the high-frequency power whose frequency is 30 kHz is supplied from the power supply 51 to the induction heating coil 52.

In such a testing apparatus 50, magnetic forces were supplied to a test piece 53 by driving the power supply 51 with the test piece 53 placed above the induction heating coil 52, and a resulting temperature rise of the test piece 53 was measured to obtain the above produced heat amount ratio.

The test piece 53 was prepared to include a temperature-sensitive metal layer 531 having a square plan view of 100 mm×100 mm and a thickness of 25 μm and made of an alloy of iron (Fe) and nickel (Ni) and a nonmagnetic metal layer 532 made of copper (Cu) and placed on the temperature-sensitive metal layer 531. A test piece 53, which serves as a basis, is the one including no nonmagnetic metal layer 532. Six kinds of test pieces were prepared by placing six different nonmagnetic metal layers 532 on this basis test piece 53. In the six kinds of test pieces 53, the thicknesses of the nonmagnetic metal layers 532 were 5 μm, 10 μm, 15 μm, 20 μm, 30 μm and 50 μm. The respective test pieces 53 were induction-heated and the temperatures thereof were measured. FIG. 8 was obtained by plotting values obtained by converting the temperature measurement results into the produced heat amount ratios in the graph.

As can be seen from the graph of FIG. 8, if copper (Cu) was used for the nonmagnetic metal layer 321, it was confirmed that the amount of produced heat by the total Joule heat of the nonmagnetic metal layer 321 and the temperature-sensitive metal layer 322 reached its maximum when the thickness of the copper (Cu) was 5 μm. It was also confirmed that the amount of heat produced by the test piece 53 was larger than the one produced singly by the temperature-sensitive metal layer 322 when the thickness was 7.0 μm or smaller and the amount of the produced heat increased at an increasing rate particularly within a range of 2.0 to 6.0 μm. This means that the amount of heat produced by the fixing roller can be larger than the one produced singly by the temperature-sensitive metal layer 322 by setting the thickness of the nonmagnetic metal layer 321 made of copper to 7.0 μm or smaller. From the above result, it can be said that the thickness of the copper (Cu) is desirably set at least at 7.0 μm or smaller, particularly within the range of 2.0 to 6.0 μm.

Figure 9:
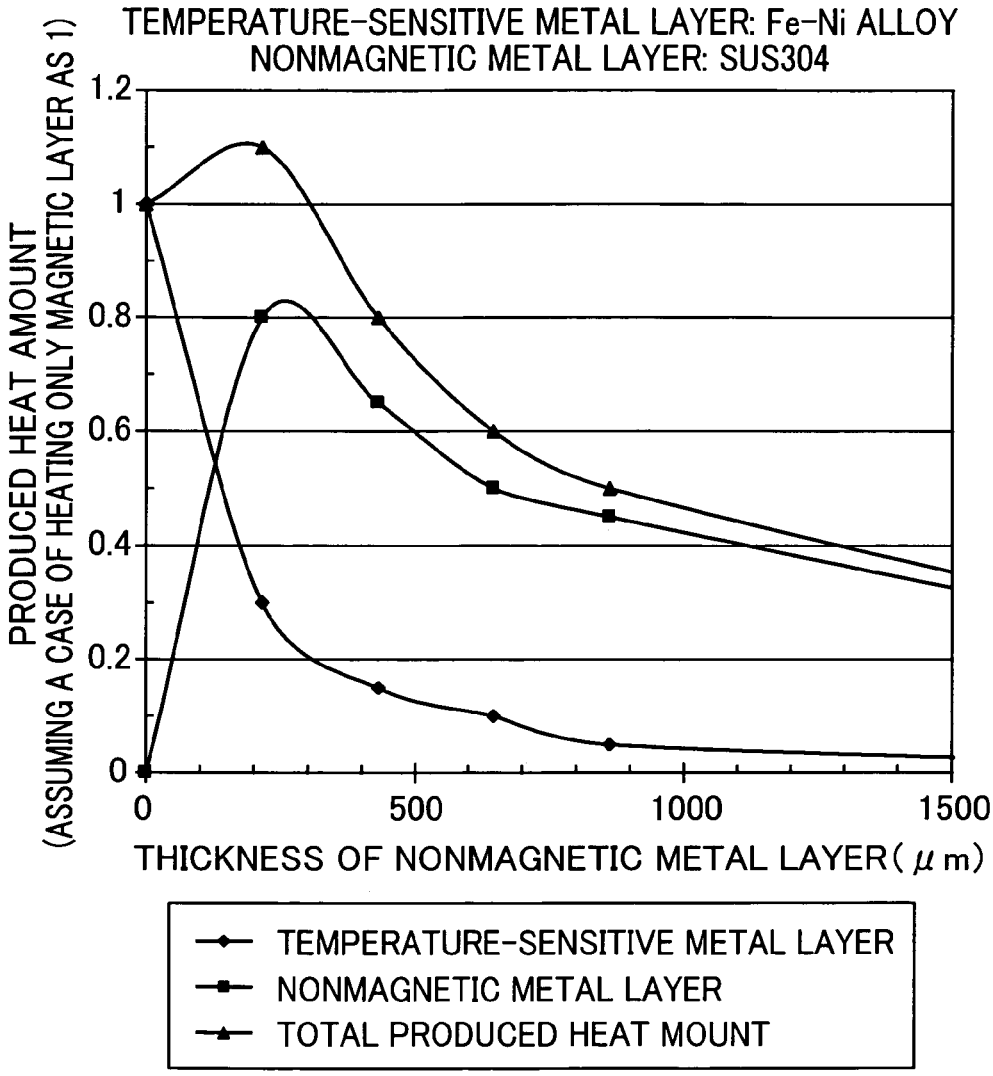
FIG. 9 is a graph showing relationships between the thickness of a nonmagnetic metal layer made of stainless steel (SUS304) and an amount of Joule heat evolved in the heating layer comprised of the nonmagnetic metal layer and the temperature-sensitive metal layer at a temperature equal to or below the Curie temperature.

A similar test was conducted also for stainless steel (SUS304), which is a nonmagnetic metal. This test result is shown in FIG. 9. As shown in a graph of FIG. 9, if the nonmagnetic metal layer 321 was made of stainless steel (SUS304), it was confirmed that the amount of produced heat by the total Joule heat of the nonmagnetic metal layer 321 and the temperature-sensitive metal layer 322 reached its maximum when the thickness of this stainless steel was about 200 μm. It was also confirmed that the amount of heat produced by the test piece 53 was larger than the one produced singly by the temperature-sensitive metal layer 322 when the thickness was 300 μm or smaller and the amount of the produced heat increased at an increasing rate particularly within a range of 90 to 257 μm.

As a result of a similar test conducted also for aluminum, which is a nonmagnetic metal, it was confirmed that the amount of produced heat by the total Joule heat of the nonmagnetic metal layer 321 and the temperature-sensitive metal layer 322 reached its maximum when the thickness of the aluminum was about 7 μm. It was also confirmed that the amount of heat produced by the test piece 53 was larger than the one produced singly by the temperature-sensitive metal layer 322 when the thickness was 11.0 μm or smaller and the amount of the produced heat increased at an increasing rate particularly within a range of 3.3 to 9.5 μm.

Figure 10A:
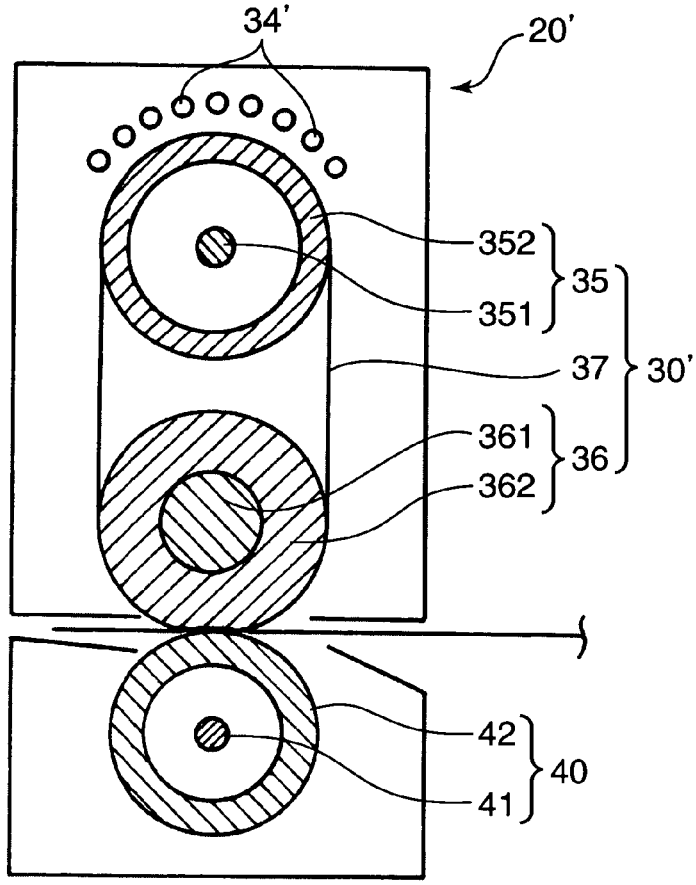
Figure 10B:
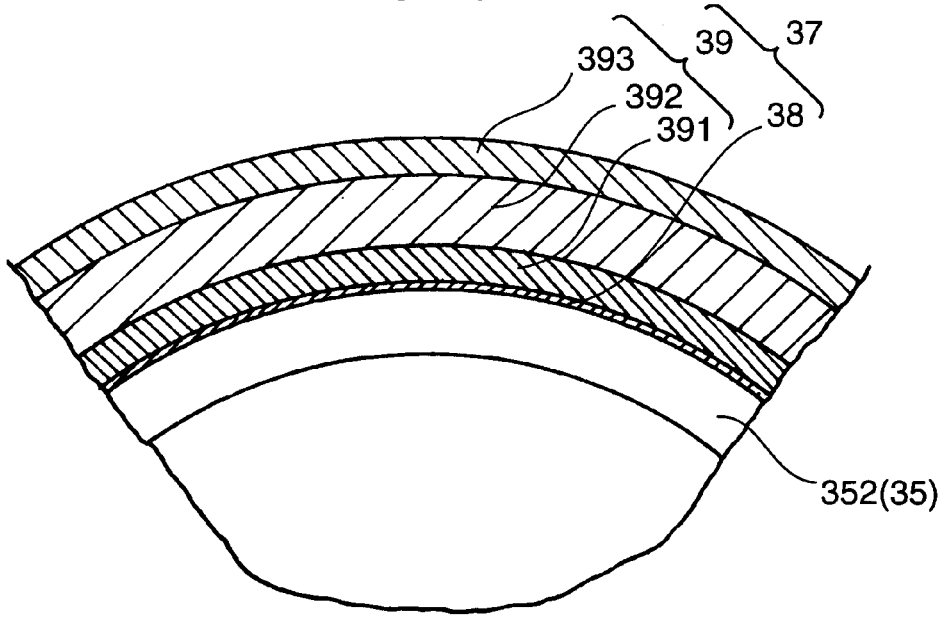
Figure 11A:
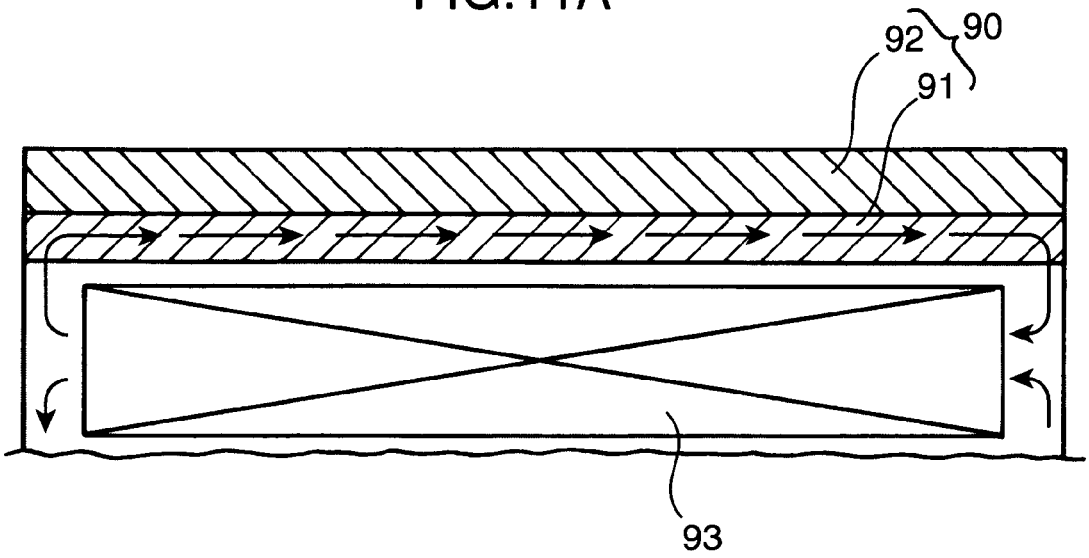
PRIOR ART FIG.11A
Figure 11B:
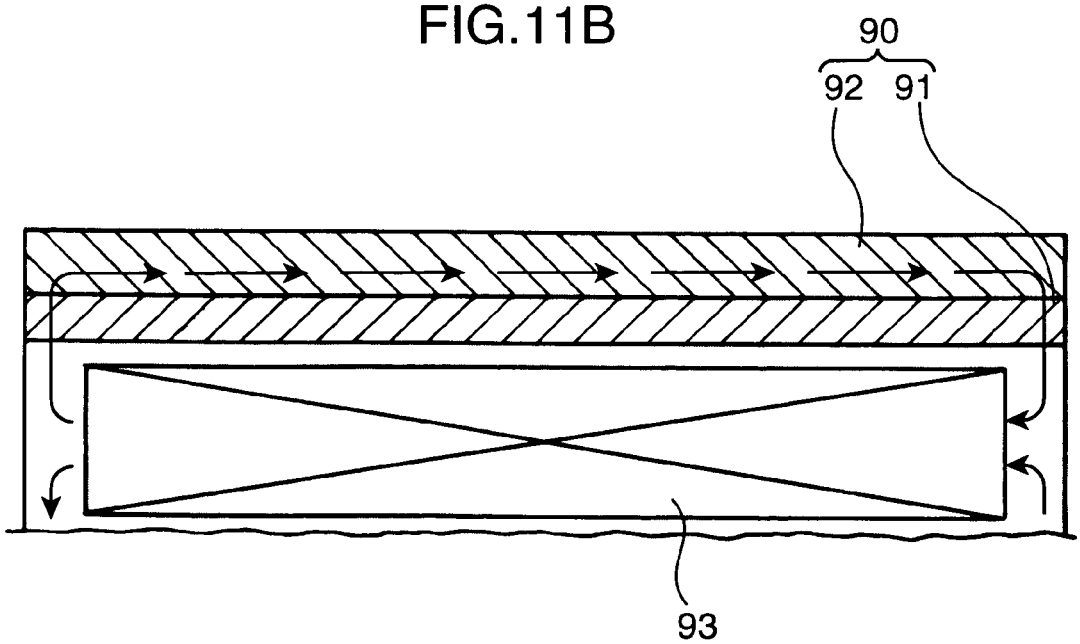
PRIOR ART FIG.11B

Next, a fixing device according to a second embodiment of the present invention is described. FIGS. 10A and 10B are schematic diagrams of a fixing device 20' according to the second embodiment, wherein FIG. 10A is a front view in section of the fixing device 20' and FIG. 10B is an enlarged section of a fixing belt 37. First, as shown in FIG. 10A, in the fixing device 20' of the second embodiment, a fixing member 30' is provided with a tension roller (one supporting roller) 35, a fixing roller (other supporting roller) 36 opposed to the tension roller 35 from below, an endless fixing belt 37 mounted between the tension roller 35 and the fixing roller 36, and an induction coil 34' opposed to the fixing belt 37 at a position above the tension roller 35. The other construction of the fixing device 20' is similar to the one of the first embodiment.

The tension roller 35 includes a tension roller shaft 351 and a temperature-sensitive metal tube (temperature-sensitive metal layer) 352 concentric with and integrally rotatable about the tension roller shaft 351. The tension roller shaft 351 is rotated clockwise by being driven by an unillustrated drive motor, whereby the temperature-sensitive metal tube 352 rotates together with the tension roller shaft 351. In this embodiment, the temperature-sensitive metal tube 352 has a thickness of 0.1 mm and made of an alloy of iron (Fe) and nickel (Ni).

The fixing roller 36 includes a fixing roller shaft 361 arranged in parallel with and in the same direction as the tension roller shaft 351 and a fixing roller main body 362 concentrically and integrally formed on the outer circumferential surface of the fixing roller shaft 361. In this embodiment, the fixing roller main body 362 is made of a so-called silicon sponge that is a foamed body of silicon rubber, whereby the fixing roller main body 362 can be elastically compressed radially inward while being pressed in contact with the pressure roller 42 via the fixing belt 37.

As shown in FIG. 10B, the fixing belt 37 includes a nonmagnetic metal layer 38 in the form of an endless belt made of nonmagnetic metal and arranged at the innermost side, and a resin layer 39 in the form of an endless belt placed on the outer side of the nonmagnetic metal layer 38. The nonmagnetic metal layer 38 has a thickness of 5 μm and made of copper (Cu) in this embodiment.

The resin layer 39 is comprised of a supporting layer 391 made of PI (polyimide) for supporting the metal layer 38, an elastic layer 392 made of silicon rubber, having the same function as the elastic layer 331 of the first embodiment and having a similar thickness (100 μm), and a parting layer 393 made of PFA and having a similar thickness (50 μm). The nonmagnetic metal layer 38 is formed by applying deposition on the inner surface of the supporting layer 391.

According to the thus constructed fixing device 20' of the second embodiment, magnetic fluxes from the induction coil 34' are supplied toward the outer surface of the fixing belt 37 while the fixing belt 37 turns between the tension roller 35 and the fixing roller 36 by the rotation of the tension roller 35, whereby the fixing belt 37 is heated by Joule heat produced by the permeation of the magnetic fluxes through the nonmagnetic metal layer 38 and, simultaneously, the temperature-sensitive metal tube 352 is quickly heated up to a Curie temperature by Joule heat produced by an excitation of an eddy current.

Accordingly, if a sheet P is supplied to a nip portion N in this state, it is moved to left in FIG. 10A while being held between the fixing belt 37 and the pressure roller 42 with the fixing roller main body 362 elastically compressed. During this movement, a fixing operation is applied to the sheet P by the heat from the fixing belt 37.

When the temperature of the temperature-sensitive metal tube 352 exceeds the Curie temperature, a depth of magnetic permeation a of the temperature-sensitive metal tube 352 increases to thereby prevent the overheating or the power supply to the induction coil 34' is shut off by the load detecting circuit of the high-frequency power supply to prevent the overheating of the fixing belt 37. When the temperature of the temperature-sensitive metal tube 352 falls below the Curie temperature, the shutoff of power supply from the high-frequency power supply is canceled, whereby the temperature-sensitive metal tube 352 is induction-heated again. Thereafter, the temperature of the fixing belt 37 progresses while increasing and decreasing within a permissible range with the Curie temperature as a boundary.

Since no mechanical strength is required for the fixing belt 37 in the second embodiment, the nonmagnetic metal layer 38 can be thinned up to an utmost value (5 microns).

The present invention is not limited to the foregoing embodiments and also embraces the following contents.

Although the printer 10 is adopted as an image forming apparatus in the foregoing embodiments, the image forming apparatus is not limited thereto and may be a copier for transferring a toner image based on image information read by a scanner to a sheet P or a facsimile apparatus for transferring a toner image based on electrically received image information to a sheet P according to the present invention.

In the second embodiment, a temperature-sensitive metal may be placed on the inner surface of the nonmagnetic metal layer 38 to provide a temperature-sensitive metal layer in the form of an endless belt on the fixing belt 37 instead of providing the tension roller 35 with the temperature-sensitive metal tube 352. This arrangement can improve the strength of the fixing belt 37.

As described above, a fixing device according to one embodiment of the present invention is provided with a fixing member for thermally fixing a transferred toner image to a transfer material and a pressing member to be held in contact with the fixing member to form a nip portion where the transfer material is caused to pass through, wherein the fixing member includes a nonmagnetic metal layer made of nonmagnetic metal, a temperature-sensitive metal layer made of temperature-sensitive metal and an induction coil for induction heating by supplying magnetism to the nonmagnetic metal layer and the temperature-sensitive metal layer, and the thickness of the nonmagnetic metal layer is set such that an amount of heat produced by the fixing member is larger than an amount of heat produced singly by the temperature-sensitive metal.

With this construction, by setting the thickness of the nonmagnetic metal layer smaller than a depth of magnetic permeation, magnetic fluxes supplied from the induction coil first reach the temperature-sensitive metal layer through the nonmagnetic metal layer, travel in the temperature-sensitive metal layer and then return to the induction coil after passing through the nonmagnetic metal layer again.

Accordingly, the fixing member is heated by Joule heat produced in the nonmagnetic metal layer in addition to by Joule heat produced under a condition that the temperature of the temperature-sensitive metal layer is equal to or below a Curie temperature.

The inventor of the present invention found out that the nonmagnetic metal layer functioned as an adjusting layer for making an eddy current load proper by setting the thickness of the nonmagnetic metal layer within a specified range in such a construction. Specifically, the inventor found out that, by adjusting the thickness of the nonmagnetic metal layer according to the material used therefor, the eddy current load could be made smaller (more reduced) in the case where the temperature-sensitive metal layer and the nonmagnetic metal layer were combined than in the case where the temperature-sensitive metal layer was singly provided, with the result that the amount of heat produced by the fixing member could be made larger than the amount of heat produced singly by the temperature-sensitive metal layer. The above construction is based on such a finding and can more efficiently transmit thermal energy to an element to be heated.

As described above, the amount of heat produced by the fixing member can be made larger than the amount of heat produced singly by the temperature-sensitive metal layer by letting the nonmagnetic metal layer function as the adjusting layer for the eddy current load. Accordingly, the thermal energy can be efficiently transmitted to the element to be heated to improve the heating efficiency, and the shortening of the warm-up period can be realized. Further, instability in the permeability of the temperature-sensitive metal layer can be compensated for by attaching the nonmagnetic metal layer and a desired eddy current load can be easily set.

The temperature-sensitive metal layer has such instability that the permeability thereof is likely to vary depending on its production and processing conditions. Accordingly, the instability of the eddy current load cannot be denied, either. However, by attaching the nonmagnetic metal layer as the adjusting layer for the eddy current load as in the above construction, the eddy current load can be stabilized, i.e. a targeted eddy current load value can be easily set.

Preferably, the nonmagnetic metal layer includes a tubular nonmagnetic metal layer formed at a side toward the induction coil and the temperature-sensitive metal layer includes a tubular temperature-sensitive metal layer placed on the nonmagnetic metal layer.

In such a case, the present invention is applicable to a fixing device including a tubular fixing roller widely used in general. Therefore, the present invention is applicable to various image forming apparatuses.

Preferably, the nonmagnetic metal layer is made of copper, which is a nonmagnetic metal, and the thickness thereof is set at 7.0 μm or smaller.

In such a case, an amount of heat the induction coil receives from the heated fixing member is reduced by making the nonmagnetic metal layer of copper having a low heat radiation rate, thereby effectively preventing an occurrence of such an inconvenience of burning out the induction coil. Further, the eddy current load in the case of combining the temperature-sensitive metal layer and the nonmagnetic metal layer made of copper can be made proper by setting the thickness of the nonmagnetic metal layer made of copper at least at 7.0 μm or smaller.

Since copper having a low heat radiation rate is used for the nonmagnetic metal layer in this way, the amount of heat the induction coil receives from the heated fixing member is reduced, thereby effectively preventing an occurrence of such an inconvenience of burning out the induction coil. Further, by setting the thickness of the nonmagnetic metal layer made of copper at least at 7.0 μm or smaller, the eddy current load in the case of combining the temperature-sensitive metal layer and the nonmagnetic metal layer made of copper can be made proper.

Preferably, the nonmagnetic metal layer is made of copper, which is a nonmagnetic metal, and the thickness thereof is set at 2.0 μm or larger and 6.0 μm or smaller.

In such a case, since copper having a low heat radiation rate is used for the nonmagnetic metal layer, the amount of heat the induction coil receives from the heated fixing member is reduced, thereby effectively preventing an occurrence of such an inconvenience of burning out the induction coil. Further, by setting the thickness of the nonmagnetic metal layer made of copper to 2.0 μm or larger and 6.0 μm or smaller, the eddy current load in the case of combining the temperature-sensitive metal layer and the nonmagnetic metal layer made of copper can be made proper.

Preferably, the nonmagnetic metal layer is made of aluminum, which is a nonmagnetic metal, and the thickness thereof is set at 11.0 μm or smaller.

In such a case, by using aluminum having a low heat radiation rate for the nonmagnetic metal layer, the amount of heat the induction coil receives from the heated fixing member is reduced, thereby effectively preventing an occurrence of such an inconvenience of burning out the induction coil. Further, by setting the thickness of the nonmagnetic metal layer made of aluminum at 11.0 μm or smaller, the eddy current load in the case of combining the temperature-sensitive metal layer and the nonmagnetic metal layer made of aluminum can be made proper. Further, since aluminum is more inexpensive than copper, the use of aluminum can contribute to a reduction in the production cost of the fixing device.

Since aluminum having a low heat radiation rate is used for the nonmagnetic metal layer in this way, the amount of heat the induction coil receives from the heated fixing member is reduced, thereby effectively preventing an occurrence of such an inconvenience of burning out the induction coil. Further, by setting the thickness of the nonmagnetic metal layer made of aluminum at least at 11.0 μm or smaller, the eddy current load in the case of combining the temperature-sensitive metal layer and the nonmagnetic metal layer made of aluminum can be made proper. Further, since aluminum is more inexpensive than copper, the use of aluminum can contribute to a reduction in the production cost of the fixing device.

Preferably, the nonmagnetic metal layer is made of aluminum, which is a nonmagnetic metal, and the thickness thereof is set at 3.3 μm or larger and 9.5 μm or smaller.

In such a case, by using aluminum having a low heat radiation rate for the nonmagnetic metal layer, the amount of heat the induction coil receives from the heated fixing member is reduced, thereby effectively preventing an occurrence of such an inconvenience of burning out the induction coil. Further, by setting the thickness of the nonmagnetic metal layer made of aluminum at 3.3 μm or larger and 9.5 μm or smaller, the eddy current load in the case of combining the temperature-sensitive metal layer and the nonmagnetic metal layer made of aluminum can be made proper. Further, since aluminum is more inexpensive than copper, the use of aluminum can contribute to a reduction in the production cost of the fixing device.

Preferably, the nonmagnetic metal layer is made of nonmagnetic stainless steel, which is a nonmagnetic metal, and the thickness thereof is set at 300 μm or smaller.

In such a case, by setting the thickness of the nonmagnetic metal layer made of nonmagnetic stainless steel at 300 μm or smaller, the eddy current load in the case of combining the temperature-sensitive metal layer and the nonmagnetic metal layer made of nonmagnetic stainless steel can be made proper. Further, since the nonmagnetic stainless steel is a tough material having a high Yong's modulus, it can be used as a constructional material for the fixing member.

Since the thickness of the nonmagnetic metal layer made of nonmagnetic stainless steel is set at least at 300 μm or smaller, the eddy current load in the case of combining the temperature-sensitive metal layer and the nonmagnetic metal layer made of nonmagnetic stainless steel can be made proper. Further, since the nonmagnetic stainless steel is a tough material having a high Yong's modulus, it can be used as a constructional material for the fixing member.

Preferably, the nonmagnetic metal layer is made of nonmagnetic stainless steel, which is a nonmagnetic metal, and the thickness thereof is set at 90 μm or larger and 257 μm or smaller.

In such a case, by setting the thickness of the nonmagnetic metal layer made of nonmagnetic stainless steel at 90 μm or larger and 257 μm or smaller, the eddy current load in the case of combining the temperature-sensitive metal layer and the nonmagnetic metal layer made of the nonmagnetic stainless steel can be made proper. Further, since the nonmagnetic stainless steel is a tough material having a high Yong's modulus, it can be used as a constructional material for the fixing member.

Preferably, the thickness of the temperature-sensitive metal layer is set such that the eddy current load thereof is 0.003Ω or smaller or the temperature-sensitive is made of an alloy of iron and nickel, which is a temperature-sensitive metal, and the thickness thereof is set at 200 μm or larger.

Here, the eddy current load is a load defined by the following equation.

$$R=\rho/z$$

where R: eddy current load (Ω), ρ: specific resistance (Ω·m), z: depth where the eddy current occurs (i.e. depth of magnetic permeation) (m). This eddy current load R is judged by the thickness d of the temperature-sensitive metal layer and expressed as below:

$$R=\rho/d.$$

This indicates that the value of the eddy current load R of the temperature-sensitive metal layer can be set according to the thickness d.

On the other hand, an occurrence of an inconvenience of overheating the fixing member was empirically confirmed due to an excessive amount of heat produced by the Joule heat produced by the temperature-sensitive metal layer if the eddy current load R of the temperature-sensitive metal layer exceeded 0.003Ω. Accordingly, the overheating of the fixing member can be prevented by calculating back such a thickness d of the temperature-sensitive metal layer as to render an eddy current load R of 0.003Ω or smaller from the above equation "R=ρ/d" and making the thickness of the temperature-sensitive metal layer larger than d. The thickness d of this temperature-sensitive metal layer is 200 μm in the case where the temperature-sensitive metal is an alloy of iron and nickel.

Accordingly, if heating is performed with the thickness d of the temperature-sensitive metal layer set at d (i.e. with the amount of heat produced by the Joule heat held down), a loss (heat evolution) in the power supply for the coil becomes larger, which leads not only to inefficiency, but also to a possibility of burning out the power supply. In order to prevent such a situation, a load detecting circuit is provided in the power supply beforehand so as to be able to give an alarm or to stop the heat output by an automatic stop function if the load falls below a specified level. As a result, the overheating of the fixing member can be prevented.

A load variation in the high-frequency power supply can be detected with ease by setting the eddy current load or the thickness as described above, with the result that the overheating of the fixing member can be securely prevented.

The Curie temperature of the temperature-sensitive metal is preferably set at such a temperature at which an excessive temperature rise of the fixing member can be prevented.

In such a case, it can be effectively prevented that the fixing member reaches an excessively high temperature because of the overheating of the temperature-sensitive metal layer by Joule heat.

Since the Curie temperature of the temperature-sensitive metal layer is set at such a temperature as to be able to prevent an excessive temperature rise of the fixing member, it can be effectively prevented that the fixing member reaches an excessively high temperature because of the overheating of the temperature-sensitive metal layer by Joule heat.

The eddy current load of the nonmagnetic metal layer is preferably set at $2.4\times10^{-3}\Omega$ or higher, and more preferably $2.8\times10^{-3}\Omega$ or higher and $8.0\times10^{-3}\Omega$ or lower. In such a case, the induction heating can be effectively performed.

Preferably, the nonmagnetic metal layer includes a nonmagnetic metal layer in the form of an endless belt formed at the side toward the induction coil, and the temperature-sensitive metal layer includes a tubular temperature-sensitive metal layer held in contact with part of the nonmagnetic metal layer.

In such a case, the present invention is applicable to a fixing device including a fixing belt in the form of an endless belt. Therefore, the present invention is applicable to various image forming apparatuses using a fixing belt.

Preferably, the nonmagnetic metal layer includes a nonmagnetic metal layer in the form of an endless belt formed at the side toward the induction coil and the temperature-sensitive metal layer includes a temperature-sensitive metal layer in the form of an endless belt placed on the nonmagnetic metal layer.

In such a case, the present invention is applicable to a fixing device including a fixing belt in the form of an endless belt. Therefore, the present invention is applicable to various image forming apparatuses using a fixing belt, and the strength of the fixing belt can be improved.

An image forming apparatus according to one embodiment of the present invention is provided with the above fixing device. In this image forming apparatus, the amount of heat produced by the fixing member can be made larger than the amount of heat produced singly by the temperature-sensitive metal layer by letting the nonmagnetic metal layer function as an adjusting layer for the eddy current load. Thus, thermal energy can be efficiently transmitted to an element to be heated to improve the heating efficiency, and the shortening of a warm-up period can be realized. Further, instability in the permeability of the temperature-sensitive metal layer can be compensated for by attaching the nonmagnetic metal layer and a desired eddy current load can be easily set.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

This application is based on patent application No. 2005-089997 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device, comprising:

a fixing member for thermally fixing a transferred toner image to a transfer material, and a pressing member held in contact with the fixing member to form a nip portion where the transfer material is caused to pass through, wherein the fixing member includes:

a nonmagnetic metal layer made of nonmagnetic metal, a temperature-sensitive metal layer made of temperature-sensitive metal, and an induction coil for induction heating by supplying magnetism toward the nonmagnetic metal layer and the temperature-sensitive metal layer, the thickness of the nonmagnetic metal layer being set such that an amount of heat produced from the fixing member is larger than an amount of heat evolved singly in the temperature-sensitive metal layer.

2. A fixing device according to claim 1, wherein the nonmagnetic metal layer includes a tubular nonmagnetic metal layer formed at a side toward the induction coil, and the temperature-sensitive metal layer includes a tubular temperature-sensitive metal layer placed on the nonmagnetic metal layer.

3. A fixing device according to claim 1, wherein the nonmagnetic metal layer is made of copper, which is a nonmagnetic metal, and the thickness thereof is set at 7.0 μm or smaller.

4. A fixing device according to claim 1, wherein the nonmagnetic metal layer is made of copper, which is a nonmagnetic metal, and the thickness thereof is set at 2.0 μm or larger and 6.0 μm or smaller.

5. A fixing device according to claim 1, wherein the nonmagnetic metal layer is made of aluminum, which is a nonmagnetic metal, and the thickness thereof is set at 11.0 μm or smaller.

6. A fixing device according to claim 1, wherein the nonmagnetic metal layer is made of aluminum, which is a nonmagnetic metal, and the thickness thereof is set at 3.3 μm or larger and 9.5 μm or smaller.

7. A fixing device according to claim 1, wherein the nonmagnetic metal layer is made of nonmagnetic stainless steel, which is a nonmagnetic metal, and the thickness thereof is set at 300 μm or smaller.

8. A fixing device according to claim 1, wherein the nonmagnetic metal layer is made of nonmagnetic stainless steel, which is a nonmagnetic metal, and the thickness thereof is set at 90 μm or larger and 257 μm or smaller.

9. A fixing device according to claim 1, wherein the thickness of the temperature-sensitive metal layer is set such that an eddy current load of the temperature-sensitive metal layer is 0.003Ω or smaller.

10. A fixing device according to claim 1, wherein the temperature-sensitive metal layer is made of an alloy of iron and nickel, which is a temperature-sensitive metal, and the thickness thereof is set at 200 μm or larger.

11. A fixing device according to claim 1, wherein a Curie temperature of the temperature-sensitive metal is set at such a temperature at which an excessive temperature rise of the fixing member can be prevented.

12. A fixing device according to claim 1, wherein an eddy current load of the nonmagnetic metal layer is set at $2.4\times10^{-3}\Omega$ or larger.

13. A fixing device according to claim 1, wherein an eddy current load of the nonmagnetic metal layer is set at $2.8\times10^{-3}\Omega$ or larger and $8.0\times10^{-3}\Omega$ or smaller.

14. A fixing device according to claim 1, wherein the nonmagnetic metal layer includes a nonmagnetic metal layer in the form of an endless belt formed at a side toward the induction coil, and the temperature-sensitive metal layer includes a temperature-sensitive metal layer in the form of an endless belt placed on the nonmagnetic metal layer.

15. A fixing device according to claim 1, wherein the nonmagnetic metal layer includes a nonmagnetic metal layer in the form of an endless belt formed at a side toward the induction coil, and the temperature-sensitive metal layer includes a tubular temperature-sensitive metal layer held in contact with part of the nonmagnetic metal layer.

16. An image forming apparatus comprising a fixing device according to claim 1.

* * * * *